US012240728B2

(12) United States Patent
Priem et al.

(10) Patent No.: US 12,240,728 B2
(45) Date of Patent: Mar. 4, 2025

(54) WINDING MODULE AND WINDING INSTALLATION FOR METAL WIRES

(71) Applicant: NV Bekaert SA, Zwevegem (BE)

(72) Inventors: Johan Priem, Roeselare (BE); Johan Hugelier, Harelbeke (BE); Maarten Meyfroidt, Oostrozebeke (BE)

(73) Assignee: NV BEKAERT SA, Zwevegem (BE)

( * ) Notice: Subject to any disclaimer, the term of this patent is extended or adjusted under 35 U.S.C. 154(b) by 272 days.

(21) Appl. No.: 17/786,749

(22) PCT Filed: Jan. 7, 2021

(86) PCT No.: PCT/EP2021/050184
§ 371 (c)(1),
(2) Date: Jun. 17, 2022

(87) PCT Pub. No.: WO2021/144189
PCT Pub. Date: Jul. 22, 2021

(65) Prior Publication Data

US 2023/0022455 A1 Jan. 26, 2023

(30) Foreign Application Priority Data

Jan. 17, 2020 (EP) ..... 20152344

(51) Int. Cl.
*B65H 54/26* (2006.01)
*B65H 54/20* (2006.01)
*B65H 67/052* (2006.01)

(52) U.S. Cl.
CPC ..... *B65H 54/26* (2013.01); *B65H 54/20* (2013.01); *B65H 67/052* (2013.01); *B65H 2701/36* (2013.01)

(58) Field of Classification Search
CPC ..... B65H 54/02; B65H 54/22; B65H 54/26; B65H 54/2818; B65H 59/18; B65H 67/06;
(Continued)

(56) References Cited

U.S. PATENT DOCUMENTS 3,854,275 A * 12/1974 Bethea ..... B65H 67/065 57/276
4,043,718 A * 8/1977 Takenaka ..... B65H 54/88 242/476.1
(Continued)

FOREIGN PATENT DOCUMENTS

WO 2013/188898 12/2013
WO 2014/005734 1/2014

OTHER PUBLICATIONS

International Search Report and Written Opinion of the International Searching Authority issued Apr. 16, 2021, in International (PCT) Application No. PCT/EP2021/050184.

*Primary Examiner* — Sang K Kim
*Assistant Examiner* — Nathaniel L Adams
(74) *Attorney, Agent, or Firm* — Wenderoth, Lind & Ponack, L.L.P.

(57) ABSTRACT

A winding module and a winding installation including winding modules for winding metal wire. In such a winding installation or take-up bench a driven capstan is used to pull the metal wire through a processing installation before being led onto a take-up spool. The spool is driven by a cantilever supported shaft. In prior art take-up benches, both the capstan and the spool is reachable by an operator from the same side. This means that the capstan direction—the direction from the driven side of the capstan to the operator side—is equal to the shaft direction—the direction from the drive side of the shaft to the open end of the shaft. In the inventive winding module the capstan direction is opposite
(Continued)

Figure 2A:
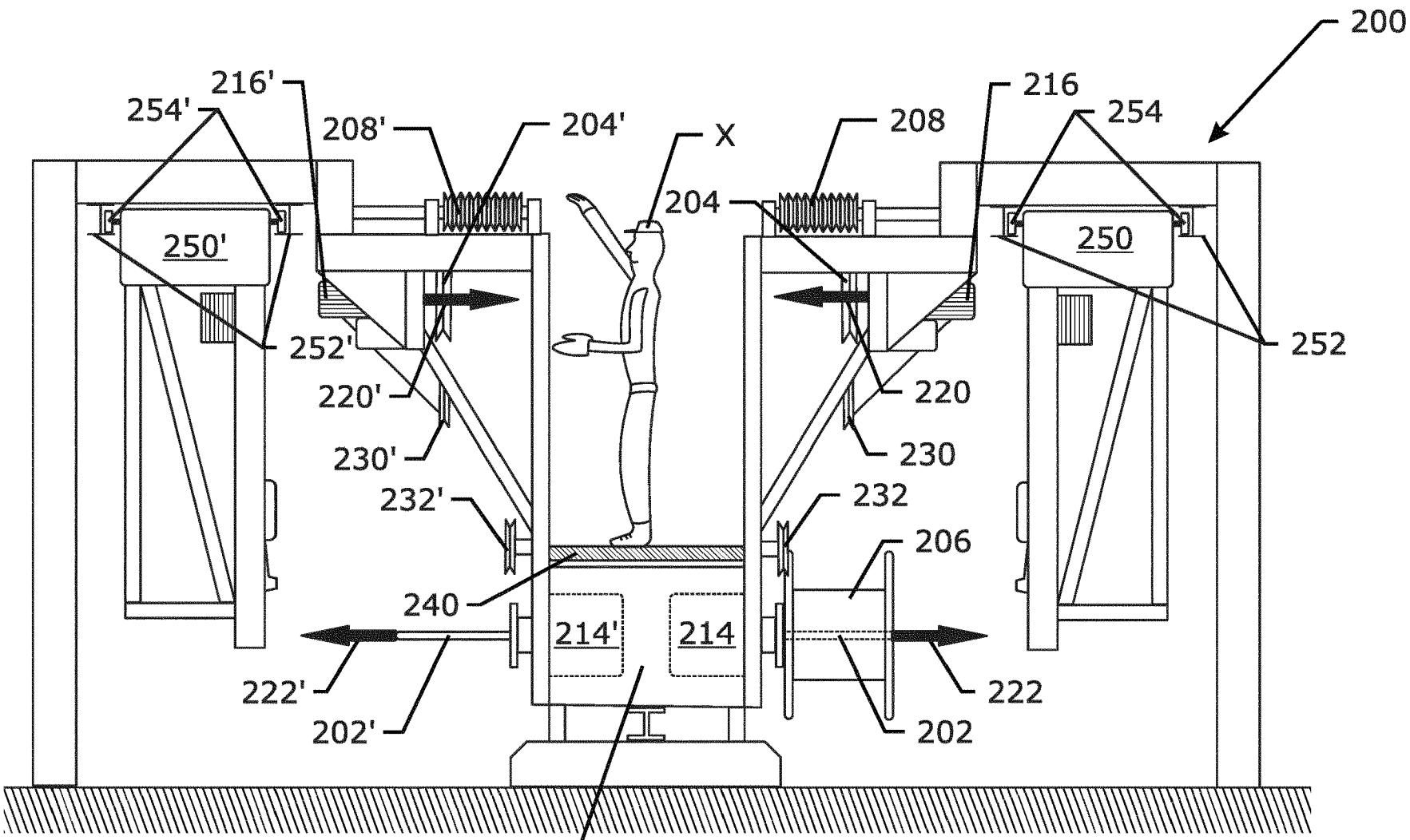

to the shaft direction, which provides a completely different operation of the winding module and the winding installation and facilitates the introduction of doffing robots.

13 Claims, 3 Drawing Sheets

(58) Field of Classification Search
CPC ..... B65H 67/064; B21C 47/00; B21C 47/02; B21C 47/04; B21C 47/045; B21C 47/12
See application file for complete search history.

(56) References Cited

U.S. PATENT DOCUMENTS

| | | | | |
|---|---|---|---|---|
| 4,938,428 | A | 7/1990 | Zaman et al. | |
| 7,845,923 | B2 * | 12/2010 | Lennemann ..... | B65H 67/064 425/464 |
| 2003/0068394 | A1 * | 4/2003 | Kirchhoff ..... | D02G 1/20 425/66 |

* cited by examiner

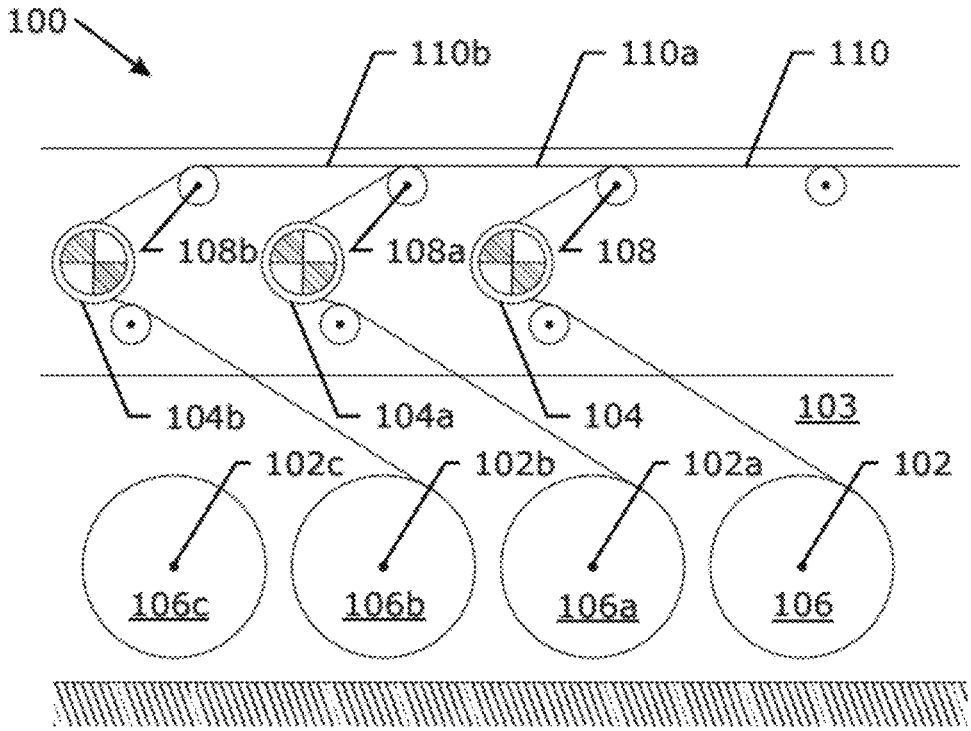
Prior Art - Fig. 1a
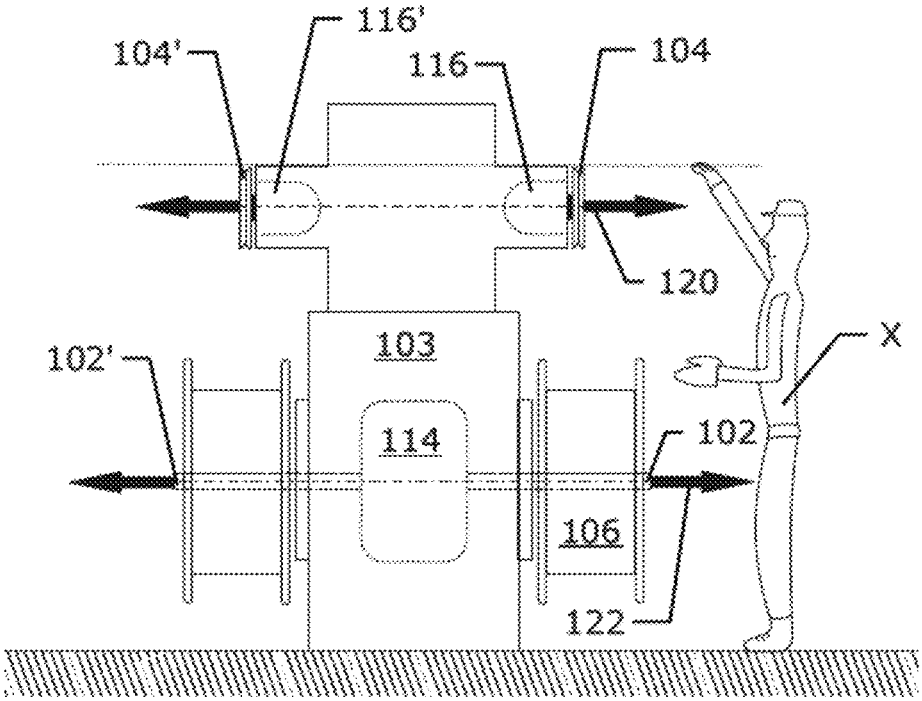
Prior Art - Fig. 1b

WINDING MODULE AND WINDING INSTALLATION FOR METAL WIRES

TECHNICAL FIELD

The invention relates to a winding module and a winding installation comprising such winding modules for winding metal wire. The winding module and winding installation winds metal wires—notably steel wires—on multiple spools concurrently.

BACKGROUND ART

In the metal wire industry process steps are executed on running wire wound from a pay-off wire carrier onto a take-up wire carrier. Sometimes the continuous process step is executed on a single wire as it moves from the pay-off spool to the take-up spool. However, for reasons of economy one seeks to combine as many processing steps on as much as possible wires in parallel on the same installation. These processing steps can for example be heat treatments, chemical treatments or coating steps.

As an example: within the field of steel cord production for the reinforcement of rubber products such as tires, hoses or belts, processing lines have been developed that combine the patenting of several parallel running steel wires with the electrolytic coating of copper and zinc followed by thermal diffusion. While in the past the steps of patenting and electrolytic coating were performed on a dozen of wires on separate processing lines—necessitating an extra unwinding and winding step with associated transport of spools—current installations combine all these steps on sixty plus wires. The diameter of the wires is generally between 0.5 mm up to 3.0 mm.

As each individual wire must be pulled through several process baths, furnaces, rolls, . . . in installations of more than hundred meters long, the wire is pulled by a pull-through capstan before being wound on a spool. The tension on the wire would prohibit the direct winding onto the spool. Hence for each wire a separate pull-through capstan and winding shaft is needed. As the number of spools is large this leads to long take-up benches that have several winding shafts with spools with associated pull-through capstans on both sides of the installation.

In order to overcome that a line must be stopped because spools are running full, operating procedures have been implemented wherein running individual wires are cut and transferred to an empty spool while the full spool is removed from the shaft that is idled. An operation commonly known as 'doffing'. This doffing necessitates human intervention in that the wire must be cut, held under tension to maintain grip on the pull-through capstan, guided to the turning empty spool until the wire grips to the spool. Thereafter the full spool can be removed from the shaft.

This way of operation necessitates that the capstans as well as the spools must be reachable from the same side by the operator. Needless to say that such an operation—even for experienced operators—requires attention as it brings some dangers with it. Furthermore, in order to do this in a safe manner, the line speed has to be reduced which leads to loss in quality and efficiency in the transition period. In addition, two operators are needed at both sides of the take-up bench.

In order to eliminate this manual doffing, doffing robots have been developed that largely reduce the work of the operator. See e.g. WO 2014/005734A1. A single doffing robot will take over the manual handling of cutting, guiding and winding from the operator. However, a new problem is now created in that the operator and the robot are working on the same side of the winding bench. This leads to potentially dangerous situations.

In order to overcome this safety problem, the inventors have come up with the following solution.

DISCLOSURE OF INVENTION

The object of the invention is to eliminate the problems of the prior art. More specifically it is an object of the invention to improve the safety of wire winding installations by the invention. It is a further object of the invention to improve the efficiency of the installation, as well as to improve the quality of the produced goods.

According a first aspect of the invention as disclosed in claim 1 a winding module is presented. The winding module is for winding metal wires on spools. For the purpose of this application, bobbins, reels and spools are considered as interchangeable words for the same object. The metal wires are for example steel wires with a diameter of between 0.5 mm and 3.0 mm. Full spools will generally have a mass of between 100 and 1000 kg, more preferred between 200 kg and 900 kg.

The winding module comprises an elongated body or housing and a first series of driven cantilever shafts that are present at a first side of the elongated body. Inside the elongated body drive means such motors, gear boxes, chain drives and the like are present to drive the shaft. The empty spools are slid over the shafts at the load end towards the supported driven end. A shaft direction can thus be defined that runs from the driven end towards the load end.

The winding module further comprises a first set of pull-through capstans associated with the first series of driven cantilever shafts. The pull-through capstans pull the wire through the installation before winding the wires on the spools. A loop of wire is laid around the capstan and when the loop is closed with a small force the wire grips and is pulled through with high force. The capstans have an operator side and a driven side. In this way a capstan direction is defined from the driven side to the operator side.

Characteristic about the invention is now that the capstan direction is oriented opposite to the shaft direction.

This is in contrast with prior art winding modules and installations where the capstan direction and the shaft direction are oriented in the same direction in order to enable the operator to service both the capstan as well as the spools on the cantilever shafts. In the inventive arrangement it has become impossible for one operator to service both the capstan and the spools on the shaft from the same side.

The inventive arrangement also brings with it that the capstans are necessarily not mounted on the same elongated body as the shafts. Indeed the capstans are preferably mounted on a carrying frame parallel to the elongated body and attached to the elongated body.

The shaft direction and capstan direction are by preference parallel to one another. Even more preferred is if the shaft direction and the capstan direction are both horizontally oriented.

According a first preferred embodiment, the number of shafts in the first series is equal to the number of capstans in the first set.

According a second preferred embodiment, the number of shafts in the first series is one (or two) more than the number of capstans in the first set.

The first embodiment can be easily transferred to the second embodiment by the removal of one capstan at one end of the module.

In a third preferred embodiment the winding module is further provided with a second series of shafts, and a second set of capstans associates with the second series of shafts. Both the second series of shafts and the second set of capstans are organised at the second, opposite side of the elongated body. The second series of shafts and the second set of capstans are oriented mirrored to the first series of shafts and first set of capstans. In this way the capacity of the winding module is doubled while sharing the same elongated body.

The number of shafts per series (be it the first series and/or the second series) can be two, three, four, five, six, seven, up to and including twelve. More preferred is a number like five, six, or seven. A module with seven shafts at either side of the module—hence fourteen shafts in total—is generally regarded as a good balance between cost of construction—as more shafts are mounted on the same elongated body—and ease of transport of the module as this corresponds to a about a truck/container length.

In a fourth preferred embodiment an operator platform is provided on top of the elongated body. From the platform the operator can easily observe and service the pull-through capstans as they are mounted at arms level. This greatly adds to the ergonomics of the work.

In a fifth preferred embodiment the winding module is provided with wire guides for guiding the metal wire towards the pull-through capstan associated with the wire. The wire guides are mounted above the first and/or second series of capstans and can be easily reached by an operator standing on the platform.

According a second aspect of the invention a winding installation is provided. The winding installation comprises one, two or more modules as described above that are placed in series, with the elongated bodies in one line. By assembling the winding installation out of winding modules a flexible design is obtained. The number of shafts needed can be increased by the addition of an additional module at the end.

In order to operate the complete installation it is advisable that there is one extra or spare shaft at each side of the installation. At the start of the doffing cycle operation—when all spools are near to full—an empty spool is mounted on the spare shaft that is then in an extremal position (at one of the ends of the installation, name this 'shaft zero'). The wire coming off the first capstan is held taut, cut between the spool and the hold, and wound till grip on the empty spool on shaft zero. The full spool is removed from the first shaft and replaced with an empty spool. The procedure is repeated. At the end of the procedure the last shaft is empty. So it suffices that at each side there is at least one shaft more than there are capstans. Of course this does not exclude that two shafts are left empty (in which case two capstans can be eliminated) for doffing, about midways of the installation.

The modules placed in series are preferably connected by a gantry. A gantry is an overhead bridge-like structure for hanging a pendant device from. The first gantry runs along the length of the installation at the load side of the first series of shafts. On the gantry one or more doffing robots can run over the full length of the installation. The use of a gantry for the doffing robots is highly advantageous compared to a robot that runs on rails or tracks as now the floor remains free of rails or tracks. Also space remains below the robot for other purposes such as a transport vehicle that can remove full spools and mount empty spools. A doffing robot has the advantage that doffing can take place at normal running speed resulting in a reduction of scrap and/or low quality material.

If the installation has two spare shafts—one about in the middle and one towards one end—two robots can run on one gantry without obstructing one another. This greatly reduces the doffing time.

When a first and second series of shafts is present at either side, both sides can be provided with a robot of opposite handedness.

When the spools are running near to full, the doffing robot moves from one shaft to the next and performs the operations of gripping and holding taut the wire coming from the capstan, cutting the wire between the full spool and the gripper, guiding the wire to the empty spool and fixing the wire to the empty spool. The robot moves one shaft position further along the gantry and the full spool is removed by a transport vehicle and replaced by an empty spool.

Due to the orientation of capstans and shafts an operator cannot reach the shaft side of the installation when working on the platform. So the operator can also not come close to the robot which would be a dangerous situation. The winding installation is therefore inherently safer than prior art installations.

The winding installation is also inherently more efficient due to the use of robots. Furthermore one operator can supervise the working of the machine along the entire length as inspection over the platform is possible. The main work of the operator is to thread the wires first time. In addition sample taking, inspection of process parameters are all possible tasks for the operator on the winding installation.

BRIEF DESCRIPTION OF FIGURES IN THE DRAWINGS

Figure 2B:
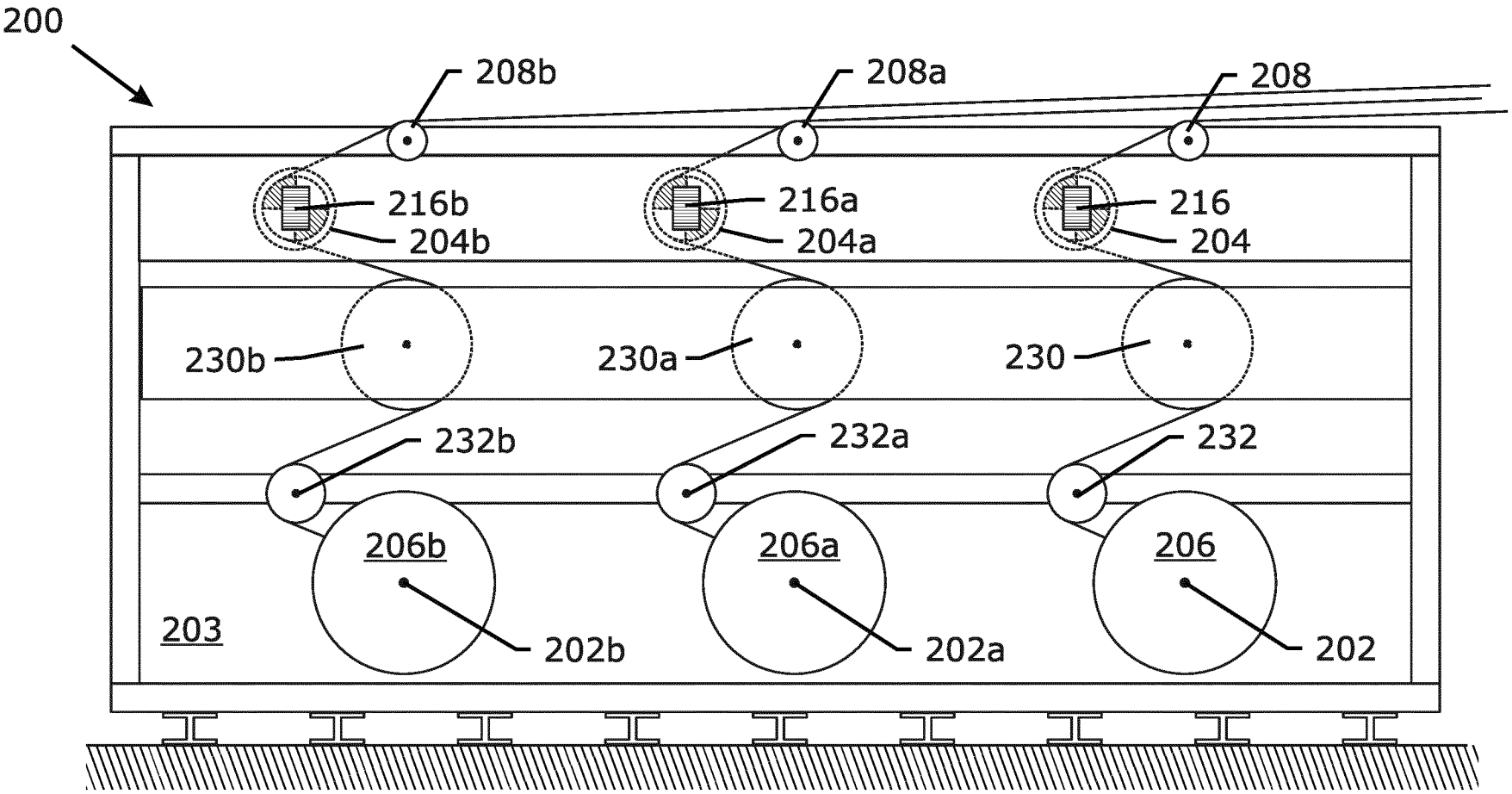

FIG. 1*a* shows a prior art winding installation in side view;

FIG. 1*b* shows a prior art winding installation from the end, as seen in the length direction of the winding installation;

FIG. 2*a* shows the inventive winding installation from the end, as seen in the length direction of the winding installation;

FIG. 2*b* shows the inventive module from the side.

In the drawings, like unit and ten digits refer to equal items—if present—across drawings. The hundred digit refers to the figure number.

MODE(S) FOR CARRYING OUT THE INVENTION

FIG. 1*a* shows a simplified drawing of a prior art winding installation 100 as seen from the working side of the operator. FIG. 1*b* shows the prior art winding installation as seen from the end of the installation. The drawings show an elongated body 103 on which a first series of shafts 102, 102*a*, 102*b*, 102*c*, . . . are provided at a first side of the installation. The shafts carry spools 106, 106*a*, 106*b*, 106*c*, . . . in cantilever.

The shafts are driven by a motor 114 possibly situated at the end of the installation that mechanically drives all shafts from a single, central axis from the inside of the elongated body. Hence, the shafts have a supported, driven end and an unsupported load end. The shafts therefore have a shaft direction indicated with the arrow 122. Spools 106, 106*a*, 106*b*, 106*c* . . . can be slid over the respective shafts to receive wires 110, 110*a*, 110*b* . . . .

The wires 110, 110*a*, 110*b*, . . . are pulled towards the winding installation from previous process steps by a first set of pull through capstans 104, 104*a*, 104*b* . . . associated with the first series of shafts. Wire guides 108, 108*a*, 108*b* mounted at the higher level of the installation guide the wire to each respective capstan. Each pull through capstan is provided with a motor 116 at its driven side. All capstans of the first set share the same operator side. The operator is indicated 'X' with the contours of a person. The capstans have a capstan direction from the driven side to the operator side of the capstan that is indicated by the arrow 120.

The installation is mirrored at the other side of the elongated body with a second series of shafts 102' and a second set of pull through capstans 104'*f*.

In the prior art installations the shaft direction 122 and the capstan direction 120 inevitable point in the same direction namely towards the operator 'X'. Indeed, the operator 'X' must at any time be able to reach as well the capstan 104 as the spool 106 in order to be able to lead the wire from the capstan 104 towards the spool 106 during doffing.

FIG. 2*a* shows the inventive winding installation as seen from the end of the module. FIG. 2*b* shows a single module 200 as seen from the side of the shafts, without the doffing robot being present. As in the prior art the winding module 200 is based on an elongated body 203. At one side of the elongated body 203 a first series of shafts 202, 202*a*, 202*b* is mounted. The shafts are mounted cantilever, and the supported side is driven by a motor 214. The unsupported end is the load end. It is preferred that each shaft is driven by an individual motor 214 in order to ease the automation with the doffing robot. In this way a shaft direction indicated by the arrow 222 is defined. On the shafts spools 206, 206*a*, 206*b*' can be mounted.

Above the elongated body a first set of pull through capstans 204, 204*a*, 204*b* is mounted on a frame connected to the elongated body 203. The first set of capstans is associated, is spatially positioned to co-operate with the first series of shafts 202, 202*a*, 202*b*. Each of the pull through capstans is provided with a drive motor 216, 216*a*, 216*b* that directly drives the capstan from the driven side. The capstan is freely reachable by the operator from the operator side. This defines the capstan direction indicated by the arrow 220 that points from the driven side towards the operator side.

Contrary to the prior art the capstan direction 220 is oriented opposite to the shaft direction 222 in the inventive winding module.

The number of shafts in the first series is equal to the number of capstans in the first set. One pull-through capstan can be easily removed resulting an end winding module that then is provided with a spare shaft. This in order to enable doffing. Also a middle module can be provided with an extra shaft by removal of a capstan.

The winding module can further be provided with diverting wheels such as 230, 230*a*, 230*b* and guiding wheels 232, 232*a*, 232*b* that serve to lead the wire in a back-and-forth movement over the width of the spool 206, 206*a*, 206*b*.

By preference the winding module is mirror symmetrically extended with a second series of shafts 202' and a second set of pull-through capstans 204' at the opposite side of the elongated body. Of course the orientation of the capstan direction 220' and shaft direction 222' are reversed with respect to the first series of shafts' direction and first set of pull-through capstans' direction. In the depicted embodiment the winding module comprises three shafts at either side of elongated body. So in total six spools can be wound on this module.

The winding module is further provided with a platform 240 on top of the elongated body that extends over the complete length of the winding module that can be extended over the complete length of the winding installation. The operator 'X' can freely walk along the length of the winding module or installation.

The winding module is further provided with wire guides 208, 208*a*, 208*b* consisting of several individual pulleys mounted on the same axle. The wire guides 208, 208' of both sides are mounted within easy reach of the operator. The wire guides 208, 208' guide the different wires to their respective pull-through capstan on each side of the winding module. As there are many wires that need to be led to their respective capstans, the number of pulleys on the wire guides can be large (more than ten, even more than 30)

By putting several—for example ten or twenty—winding modules one after the other in one line, a winding installation is formed having more than ten, more then twenty or even more than forty shafts available for winding metal wire on. The platforms then form a long aisle with the different capstans on either side of it. Side ramps are provided that prevent the operator from reaching to the shaft side of the installation. It will be clear from the above that the operator cannot longer reach the load side of the shafts as this would imply that he would have to cross the wire field.

The doffing operation is then performed by one or more doffing robots 250. The robot 250 runs on a gantry 252 on wheels 254. The gantry 252 consists of two long I-beam profiles that are aligned along the complete length of the installation on which the wheels of the robot run. The robot 250 hangs from the gantry 252 which leaves sufficient space between the bottom of the robot and the floor to enable a transport vehicle (not shown) to place an empty spool on the spare shaft and to remove a full spool from the shaft following.

The robot moves stepwise along the gantry, stopping at each shaft to perform the steps of:

Gripping while holding taut the wire coming from the capstan;

Cutting the wire between the full spool and the gripper;

Guiding the wire to the empty spool;

Fixing the wire end to the empty spool core.

If a spare shaft is available close to the middle of the winding installation, two robots can do simultaneously half of the total number of shafts. This further reduces the doffing time.

The same can be provided at the opposite side of the gantry, where one or more robots 250' of opposite handedness perform the same tasks in a mirror like fashion.

The invention claimed is:

1. A winding module for winding metal wires on spools, said winding module comprising an elongated body and a first series of driven cantilever shafts for carrying spools, said shafts being present at a first side of said elongated body, said shafts having a supported driven end and a load end, defining a shaft direction from said driven end towards said load end, said winding module further comprising a first set of pull-through capstans for pulling a steel wire before winding on the spools, said first set of capstans being associated with said first series of shafts, said capstans having an operator side and a driven side, defining a capstan direction from said driven side towards said operator side, wherein said capstan direction is oriented opposite to said shaft direction, and wherein said metal wires have a diameter between 0.5 mm and 3.0 mm.

2. The winding module of claim 1, wherein the number of shafts in said first series is equal to the number of capstans in said first set.

3. The winding module according to claim 1, wherein the number of shafts in said first series is one more than the number of capstans in said first set.

4. The winding module according to claim 1 wherein said winding module comprises a second series of shafts and a second set of capstans associated with said second series of shafts, wherein said second series of shafts and said second set of capstans are organised at the second side of said elongated body opposite of said first side and are oriented mirrored to said first series of shafts and said first set of capstans.

5. The winding module according to claim 4, wherein the number of shafts in said second series is two to twelve, inclusive.

6. The winding module according to claim 4, wherein an operator platform is provided on top of said elongated body.

7. The winding module according to claim 6, further comprising wire guides, for guiding the metal wire towards the pull-through capstan associated with the wire, wherein said wire guides are mounted above said second series of capstans reachable to an operator standing on said platform.

8. The winding module according to claim 1, wherein the number of shafts in said first series is two to twelve, inclusive.

9. The winding module according to claim 1, wherein an operator platform is provided on top of said elongated body.

10. The winding module according to claim 9, further comprising wire guides, for guiding the metal wire towards the pull-through capstan associated with the wire, wherein said wire guides are mounted above said first series of capstans reachable to an operator standing on said platform.

11. A winding installation comprising one, two or more modules according to claim 1, wherein, if two or more modules are present, said modules are placed in series, with their elongated bodies in one line.

12. The winding installation according to claim 11, further comprising a first gantry running along the length of said installation at a load side of said first series of shafts, said installation further comprising one or more robots running on said first gantry.

13. The winding installation according to claim 12, wherein said winding module comprises a second series of shafts and a second set of capstans associated with said second series of shafts, wherein said second series of shafts and said second set of capstans are organised at the second side of said elongated body opposite of said first side and are oriented mirrored to said first series of shafts and said first set of capstans, and wherein the winding installation further comprises a second gantry running along the length of said installation at a load side of said second series of shafts, said installation further comprising one or more robots running on said second gantry.

* * * * *